US011196171B2

(12) United States Patent
Doyle et al.

(10) Patent No.: US 11,196,171 B2
(45) Date of Patent: Dec. 7, 2021

(54) COMBINED WAVEGUIDE AND ANTENNA STRUCTURES AND RELATED SENSOR ASSEMBLIES

(71) Applicant: VEONEER US, INC., Southfield, MI (US)

(72) Inventors: Scott B. Doyle, Sudbury, MA (US); Angelos Alexanian, Lexington, MA (US); Konstantinos Konstantinidis, Wurzburg (DE)

(73) Assignee: Veoneer US, Inc., Southfield, MI (US)

( * ) Notice: Subject to any disclaimer, the term of this patent is extended or adjusted under 35 U.S.C. 154(b) by 0 days.

(21) Appl. No.: 16/520,262

(22) Filed: Jul. 23, 2019

(65) Prior Publication Data

US 2021/0028549 A1 Jan. 28, 2021

(51) Int. Cl.
*H01Q 13/18* (2006.01)
*H01Q 1/32* (2006.01)

(52) U.S. Cl.
CPC ..... *H01Q 13/18* (2013.01); *H01Q 1/3233* (2013.01)

(58) Field of Classification Search
None
See application file for complete search history.

(56) References Cited

U.S. PATENT DOCUMENTS 7,132,905 B2 11/2006 Sano
8,779,995 B2 7/2014 Kirino et al.
8,803,638 B2 8/2014 Kildal
9,153,851 B2 10/2015 Nakamura
9,252,475 B2 2/2016 Milyakh et al.
9,666,931 B2 5/2017 Suzuki
10,164,344 B2 12/2018 Kirino et al.
2011/0050356 A1 3/2011 Nakamura et al.
2011/0187614 A1* 8/2011 Kirino ..... H01Q 3/32 343/713

(Continued)

FOREIGN PATENT DOCUMENTS

CN 102931492 2/2015
CN 106207357 12/2016

OTHER PUBLICATIONS

CN102931492, Feb. 11, 2015, Beijing Institute of Telemetry Technology, Machine Translation (9 pages).

(Continued)

*Primary Examiner* — Crystal L Hammond
(74) *Attorney, Agent, or Firm* — Matthew D. Thayne; Thayne and Davis LLC

(57) ABSTRACT

Antenna assemblies, such as RADAR or other sensor antenna assemblies for vehicles. In some embodiments, the assembly may comprise an antenna block defining a waveguide groove on a first side of the antenna block with opposing rows of posts positioned opposite from one another. A plurality of antenna slots may be positioned in the waveguide groove and may extend from the first side of the antenna block to a second side of the antenna block opposite the first side. A PCB or other means for generating electromagnetic energy may be coupled with the antenna block and be configured to feed the waveguide groove with an EM signal. The plurality of antenna slots formed in the antenna block may be configured to radiate electromagnetic energy from the antenna block.

19 Claims, 7 Drawing Sheets

(56) References Cited

U.S. PATENT DOCUMENTS

| | | | | |
|---|---|---|---|---|
| 2012/0068900 | A1* | 3/2012 | Yatabe | H01Q 13/10 343/767 |
| 2016/0254582 | A1 | 9/2016 | Jensen | |
| 2016/0308264 | A1* | 10/2016 | Vangala | H01P 1/2002 |
| 2017/0040703 | A1 | 2/2017 | Cheng et al. | |
| 2017/0084971 | A1* | 3/2017 | Kildal | H01P 3/12 |
| 2017/0187121 | A1 | 6/2017 | Kirino et al. | |
| 2017/0187124 | A1* | 6/2017 | Kirino | H01Q 13/20 |
| 2018/0301816 | A1* | 10/2018 | Kamo | H01Q 13/10 |
| 2018/0351261 | A1 | 12/2018 | Kamo et al. | |
| 2019/0074569 | A1* | 3/2019 | Kamo | G01S 13/345 |

OTHER PUBLICATIONS

CN106207357, Dec. 7, 2017, Chengdu Xanaway Technology Co., Ltd., Machine Translation (58 pages).
Nov. 19, 2020 PCT/US2020/042831 International Search Report (3 pgs).
Nov. 19, 2020 PCT/US2020/042831 Written Opinion (7 pgs).

* cited by examiner

COMBINED WAVEGUIDE AND ANTENNA STRUCTURES AND RELATED SENSOR ASSEMBLIES

SUMMARY

Disclosed herein are various embodiments of waveguide structures that may be used in connection with various electrical devices comprising electromagnetic waveguides, such as RADAR sensor modules for vehicles. Some of the waveguide structures disclosed herein may be configured to incorporate multiple elements together in a single structure, such as a die-cast part in some embodiments. For example, in some embodiments, the casting structure or other antenna block structure may comprise one or more waveguide grooves, which may be formed by opposing rows of spaced posts in some embodiments, and may comprise a plurality of slits formed within an antenna waveguide groove of the structure that preferably extend from one side of the structure to the other to allow for emission of electromagnetic radiation therethrough. In some embodiments, the slits may taper or otherwise define opposing cross-sectional areas that differ and/or may be placed in a staggered manner on opposing sides of a waveguide ridge extending from the waveguide groove.

In a more particular example of an antenna module according to some embodiments, the module may comprise an antenna block defining a waveguide groove on a first side of the antenna block. The waveguide groove may be defined, at least in part, by a plurality of posts positioned opposite from one another, such as one or more rows of spaced posts positioned on each of two opposing sides of the waveguide groove. A plurality of antenna slots may be formed in the antenna block and may extend from the first side of the antenna block to a second side of the antenna block opposite the first side. The antenna slots may also be positioned at least partially within the waveguide groove. In some such embodiments, the antenna slots may each be fully positioned within the waveguide groove. The module may further comprise a printed circuit board or another means for generating and/or receiving electromagnetic radiation, which may be coupled with the antenna block and configured to generate electromagnetic waves to feed the waveguide groove and/or receive electromagnetic waves/energy from such groove(s). The plurality of antenna slots formed in the antenna block may then be configured to transmit electromagnetic waves therethrough from the waveguide groove of the antenna block.

Some embodiments may further comprise a waveguide ridge positioned within the waveguide groove. In some such embodiments, each of the plurality of antenna slots may be formed within the waveguide groove and may be positioned adjacent to the waveguide ridge, such as in a staggered manner such that each antenna slot is on an opposite side of the waveguide ridge relative to one or more of its adjacent antenna slots.

In some embodiments, each of the plurality of slots may define a cross-sectional area that is non-constant from the first side of the antenna block to the second side. For example, in preferred embodiments, each of the plurality of slots may taper from a narrow cross-sectional area at the first side to a wider cross-sectional area at the second side such that the terminal end of its slot is larger than the initial or starting end. In some such embodiments, each of the plurality of slots may taper from a first rectangular cross-sectional area at the first side to a second rectangular cross-sectional area at the second side, wherein the first rectangular cross-sectional area is smaller than the second rectangular cross-sectional area.

In another example of an antenna module according to some embodiments, the module may comprise an antenna block defining a plurality of waveguide grooves on a first side of the antenna block. The plurality of waveguide grooves may comprise at least a feed waveguide groove and an antenna waveguide groove coupled with the feed waveguide groove. A plurality of antenna slots may also be formed in the antenna block. The plurality of antenna slots may extend from the first side of the antenna block to a second side of the antenna block opposite the first side and may be positioned at least partially (in some cases, fully) within the antenna waveguide groove. A printed circuit board or another means for generating and/or receiving electromagnetic radiation may be coupled with the antenna block and configured to generate electromagnetic waves to be sent into the feed waveguide groove. The plurality of antenna slots formed in the antenna block may be configured to transmit and/or receive electromagnetic waves therethrough from the antenna waveguide groove.

The antenna waveguide groove may be defined, at least in part, by a plurality of posts positioned opposite from one another, which posts may be spaced apart from one another to define gaps therebetween. Similarly, the feed waveguide groove may also be defined at least in part by a plurality of posts positioned opposite from one another, which posts may also be spaced apart from one another.

In some embodiments, an antenna waveguide ridge may be positioned within the antenna waveguide groove and/or a feed waveguide ridge may be positioned within the feed waveguide groove.

In some embodiments, the feed waveguide ridge may be coupled to the antenna waveguide ridge at a junction, which may comprise T-junction in some such embodiments.

In some embodiments, the feed waveguide ridge may narrow in width and/or increase in height in a direction towards the antenna waveguide ridge. In alternative embodiments, the antenna waveguide ridge may narrow in width in a direction towards the feed waveguide ridge.

One or more of the slots (in some embodiments, each of the plurality of slots) may comprise a cross-sectional area that narrows from the first side to the second side.

In some embodiments, the antenna waveguide groove may be offset from the feed waveguide groove. For example, the antenna waveguide groove may intersect the feed waveguide groove and/or be positioned on a different layer of the module with respect to the feed waveguide groove.

In still another example of an antenna module according to other embodiments, the module may comprise an antenna block comprising a first plurality of posts positioned opposite from one another to define a feed waveguide groove on a first side of the antenna block. In some embodiments, the posts on each side of the feed waveguide groove may be spaced apart from one another. A feed waveguide ridge may extend within the feed waveguide groove. The module may further comprise a second plurality of posts positioned opposite from one another to define an antenna waveguide groove, which may also be positioned on the first side of the antenna block. The antenna waveguide groove may be offset from the feed waveguide groove. The module may further comprise an antenna waveguide ridge extending within the antenna waveguide groove. The feed waveguide ridge may extend into or otherwise be coupled with the antenna waveguide ridge at a junction region, such as at a T-junction.

A plurality of antenna slots may also be formed in the antenna block, which antenna slots may extend from the first side of the antenna block to a second side of the antenna block opposite the first side. Preferably, each of the plurality of antenna slots is positioned fully, or at least partially, within the antenna waveguide groove. Preferably, each of the plurality of antenna slots is offset from the antenna waveguide ridge, such as positioned in a staggered manner on opposing sides of the antenna waveguide ridge with each adjacent antenna slot positioned on an opposite side of the antenna waveguide ridge next to one or more of its adjacent antenna slots. A printed circuit board or another suitable means for generating electromagnetic energy may be coupled with the antenna block and configured to generate and/or receive electromagnetic waves to be sent into the feed waveguide groove.

In some embodiments, the feed waveguide ridge may extend into the antenna waveguide ridge at an at least substantially perpendicular angle at the junction region.

In some embodiments, one or more (in some such embodiments, each) of the plurality of slots may comprise a cross-sectional area that narrows from the first side to the second side.

The features, structures, steps, or characteristics disclosed herein in connection with one embodiment may be combined in any suitable manner in one or more alternative embodiments.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

A detailed description of apparatus, systems, and methods consistent with various embodiments of the present disclosure is provided below. While several embodiments are described, it should be understood that the disclosure is not limited to any of the specific embodiments disclosed, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

The embodiments of the disclosure may be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the apparatus and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified. Additional details regarding certain preferred embodiments and implementations will now be described in greater detail with reference to the accompanying drawings.

Figure 1:
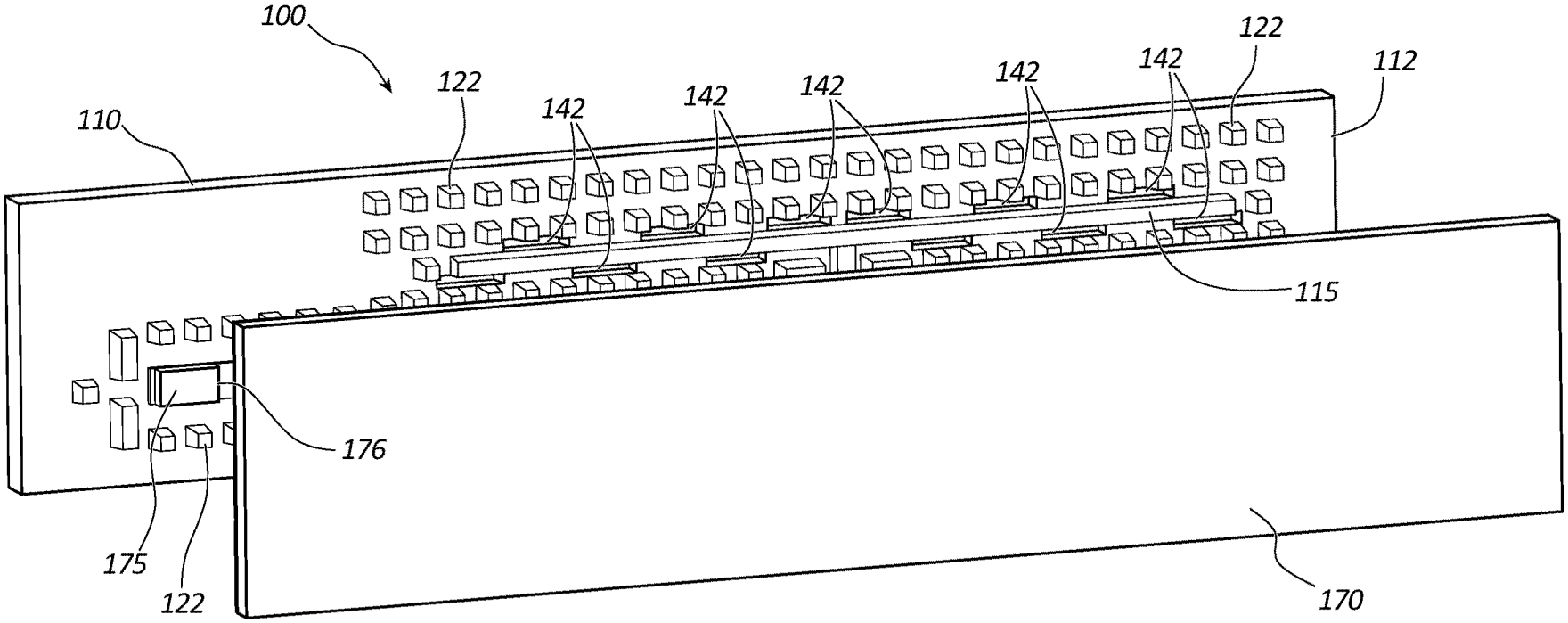
FIG. 1 is an exploded, perspective view of an antenna assembly that may be incorporated into an antenna module, such as a vehicle RADAR sensor module, according to some embodiments.

FIGS. 1-4 depict an antenna assembly 100 that may be incorporated into or otherwise used with a vehicle sensor, such as a RADAR sensor assembly, according to some embodiments. Antenna assembly 100 comprises an antenna block 110 that defines, either in whole or in part, one or more waveguides as part of an antenna array comprising one or more antennae, on one or both sides of antenna block 110. Thus, as depicted in FIG. 1, antenna block 110 comprises a plurality of posts 122 arranged in opposing rows on a first side 112 of antenna block 110 to define a waveguide groove therebetween.

It should be understood that although, in preferred embodiments, any number of antennae may be provided and therefore any desired number of corresponding antennae structures—such as a plurality of waveguides, grooves, etc.—may be provided, it is contemplated that some embodiments may comprise an array having a single antenna and therefore only a single waveguide, for example. Such antenna/waveguide/groove may curve about the block/assembly rather than be in a series of parallel lines in some embodiments. As another example, in some embodiments, grooves, slots, or the like may be arranged in a disc formation, or any other suitable formation, including linear, curved, etc. In addition, although the waveguide grooves in the depicted embodiment are defined by rows of posts, it should also be understood that waveguides may be defined in alternative ways in other embodiments, such as by forming a groove within a solid structure (i.e., no posts extending up from the structure), or in any other suitable manner available to those of ordinary skill in the art. It should also be apparent that several of the accompanying figures depict only certain elements and/or aspects of antenna assemblies and/or waveguides and that, in order to properly function, other elements would typically need to be provided in a complete assembly/module.

In preferred embodiments, antenna block 110 may comprise a casting, such as a casting comprising a Zinc or other suitable preferably metal material. However, in other contemplated embodiments, block 110 may instead, or in addition, comprise a metalized plastic, a plastic with a metal coating, or another suitable material. In some such embodiments, metallic inserts, coatings, or the like may be used. In typical sensor assemblies, which, as previously mentioned, may be configured specifically for use in connection with vehicles, other structures may be combined with block/casting 110. For example, a slotted layer may be coupled to the antenna block 110 in some embodiments, in some cases along with other layers and/or elements that are not depicted herein to avoid obscuring the disclosure, to form an antenna assembly 100. In other embodiments, electromagnetic radiation may be emitted using other slots or openings not formed in a separate layer. For example, in the embodiment depicted in FIGS. 1-4, slots 142 are formed in antenna block 110 itself and extend from side 112 to an opposite side 114 of block 110.

Figure 4:
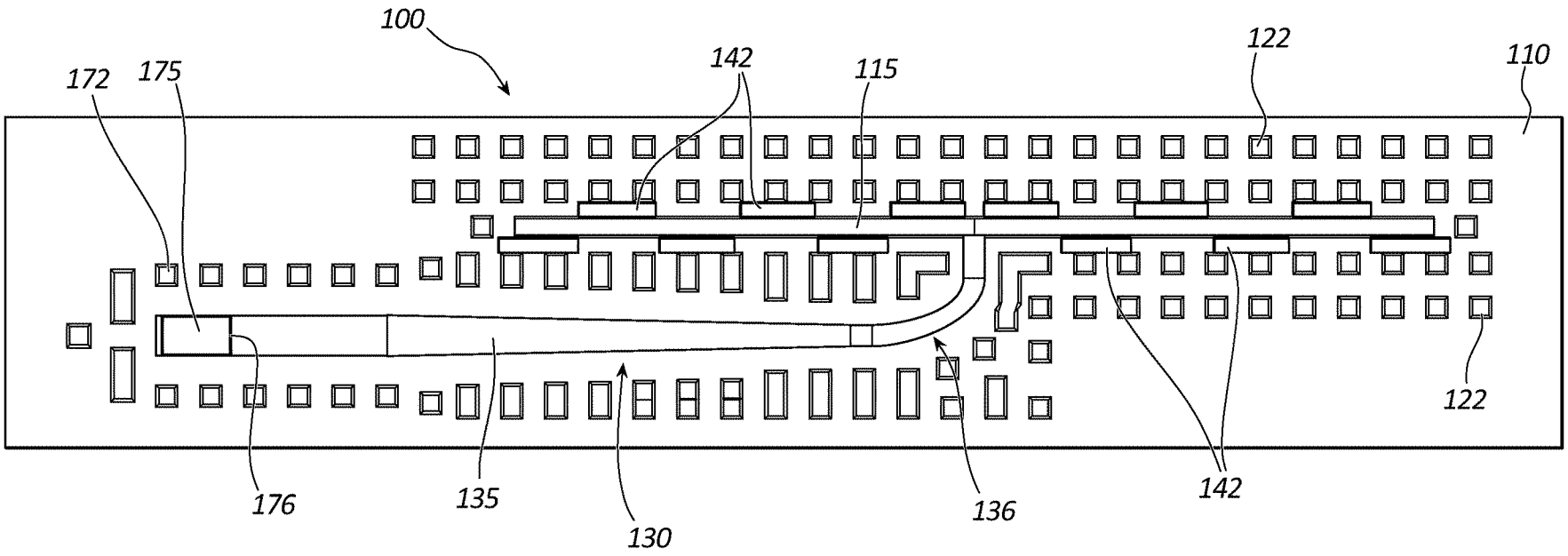
FIG. 4 is a plan view of the waveguide structures of the antenna assembly of FIGS. 1-3.

As best seen in FIGS. 1 and 4, a ridge is positioned within each of the waveguide grooves. More particularly, an elongated ridge 115 is positioned between opposing rows of posts 122, which may correspond with one or more antennae. Although two spaced rows of posts 122 are positioned on each side of ridge 115, other embodiments are contemplated in which a single row, or more than two rows, of such posts may be positioned on either side of ridge 115 or any of the other ridges disclosed herein. Because ridge 115 is positioned adjacent to slots 142, ridge 115 may be considered and referred to herein as an "antenna waveguide ridge." Similarly, the groove defined by opposing posts 122 within which slots 142 are positioned may be considered and referred to herein as an "antenna waveguide groove."

Other ridges may be positioned within other waveguide grooves of the module/assembly. Thus, ridge 135 (see FIG. 4) is also positioned between rows of opposing posts 122. However, because ridge 135 is positioned within a waveguide groove that feeds the antenna waveguide groove associated with ridge 115, there are no slots associated with ridge 135 and ridge 135 may be considered and referred to herein as a "feed waveguide ridge" extending within a "feed waveguide groove." Although this feed waveguide groove is also defined by opposing rows of posts 122 in the depicted embodiment, again, other feed waveguide grooves defined in more traditional or other ways may be used in alternative embodiments.

In addition, although in the depicted embodiment, the feed waveguide ridge is coupled to the antenna waveguide ridge in an offset manner at a T-junction in the same layer, this also need not be the case in all contemplated embodiments. For example, in some embodiments, the antenna waveguide may be on a separate layer from the feed waveguide and coupled to the feed waveguide in another suitable manner. Also, in some embodiments, the antenna waveguide groove may be aligned and/or parallel with the feed waveguide groove, in other embodiments, the antenna waveguide groove may be offset from the feed waveguide groove, either in the same layer or a different layer of the assembly.

Figure 2:
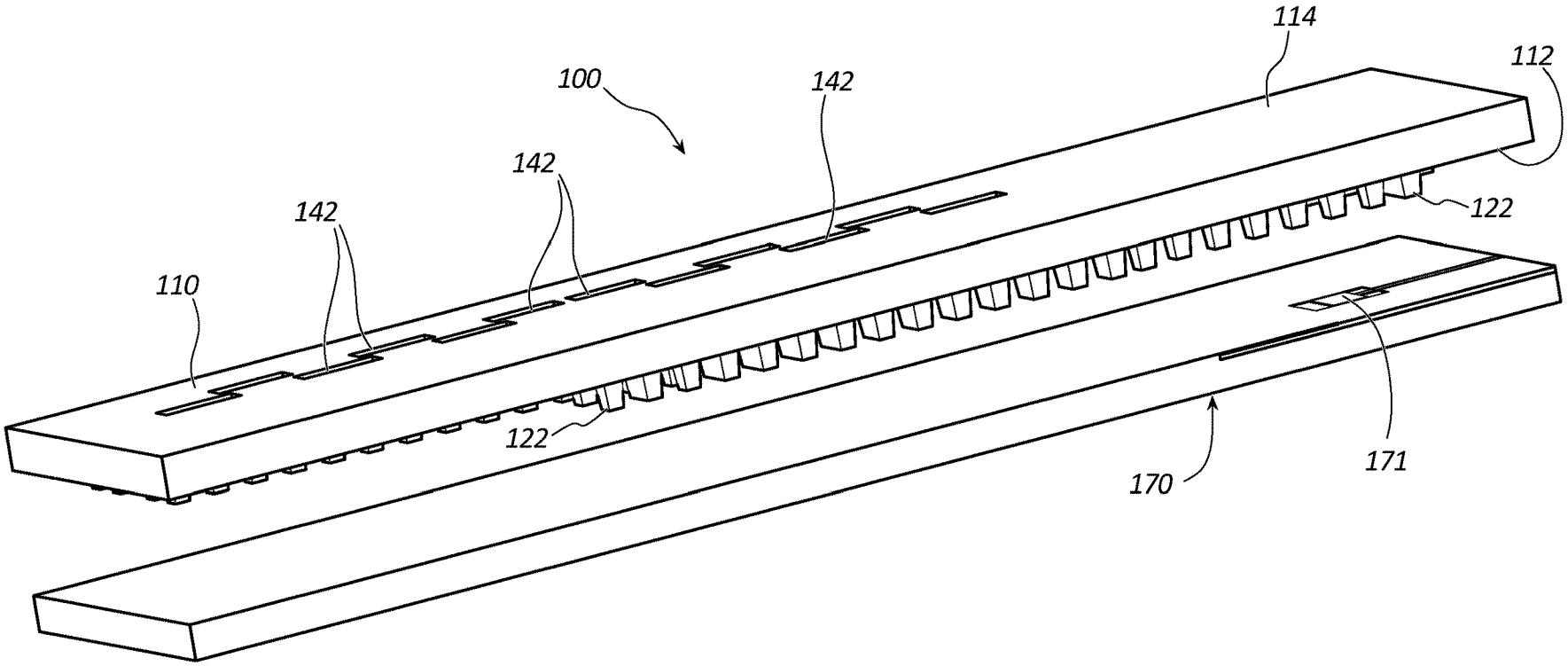
FIG. 2 is an exploded perspective view of the antenna assembly of FIG. 1 shown from the opposite side.

Electromagnetic radiation may travel within the waveguides defined by the aforementioned posts 122 and ridges 115 and may be transmitted through the various slots 142 formed in block 110. Ridges 115 may be preferred to enhance the characteristics of the waveguide by further facilitating guidance of electromagnetic waves as desired and/or for satisfying size/dimensional demands. Again, in other contemplated embodiments, such slots or other suitable openings may be formed in a separate slotted layer of antenna assembly 100 that may be coupled with block 110. As best seen in FIGS. 2 and 4, slots 142 are staggered with respect to one another on opposite sides of ridge 115.

Preferably, when a slotted layer is present, this layer comprises a metal or other conductive material. Such a slotted layer may be coupled with block 110 in a variety of possible ways. For example, an adhesive, solder, heat stakes, screws, other fasteners, and the like may be used to couple the slotted layer to block 110. Similar structures and/or techniques may be used to couple other layers or other elements of the assembly together, such as coupling the casting to a PCB, for example. In some embodiments, another layer, such as a layer of (preferably conductive) adhesive tape, may be inserted in between block 110 and the slotted layer, which may, either entirely or in part, be used to provide this coupling. In embodiments in which solder is used, such solder may be applied to the top of one or more (in some embodiments, all) of posts 122.

In addition, slots 142, or at least a subset of slots 142, are preferably formed such that the cross-sectional area from one side to the other is non-constant. More preferably, in some embodiments, slots 142 define openings through casting/block 110 that define a smaller cross-sectional area adjacent to ridge 115 than the cross-sectional area on the opposite side of casting/block 110. Thus, in some such embodiments, including the embodiment of FIGS. 1-4, each of slots 142 tapers from a narrow cross-sectional area at the inner side adjacent to ridge 115 to a wider cross-sectional area at the opposite, outer side from which electromagnetic radiation may be sent and/or received. Although both cross-sections are rectangular in the depicted embodiment, those of ordinary skill in the art will appreciate that this need not be the case in other contemplated embodiments. In addition, it should be understood that, in other embodiments, slots 142 may taper or otherwise have cross-sectional areas that vary in the opposite direction as that depicted and previously described. Similarly, in some embodiments, one or more of the corners may be rounded and the cross-section may not be precisely rectangular. It should be understood, however, that such configurations may still be considered to have an at least substantially rectangular cross-section.

Figure 3:
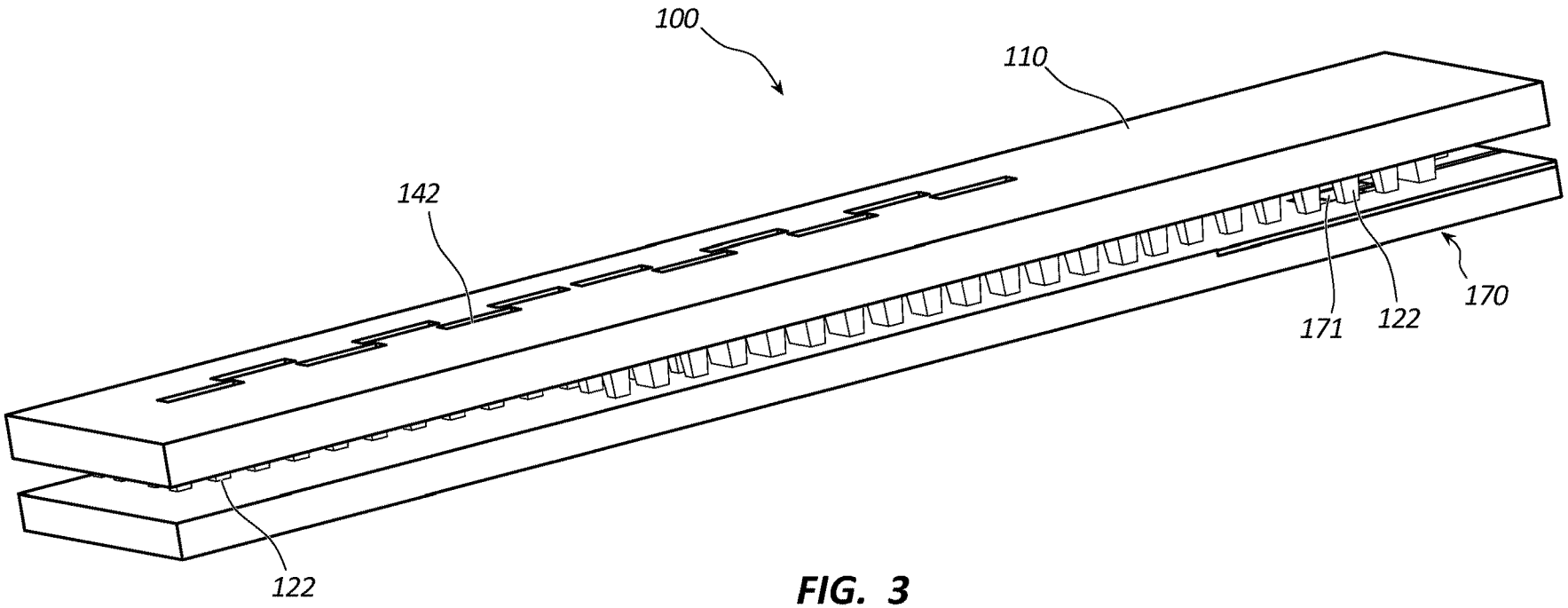
FIG. 3 is a perspective view of the antenna assembly of FIGS. 1 and 2.

As shown in FIG. 3, in some embodiments, each of the elements of assembly 100 may be integrally formed in a single layer and/or block element, including, as previously mentioned, slots 142. Alternatively, casting 110 may define posts 122 and various other elements of assembly 100 as desired and another layer may be coupled to casting 110 to define a seat or ceiling to the assembly. In some such embodiments, the additional layer may define the antenna slots.

Antenna assembly 100 further comprises a PCB or other electromagnetic-generating element 170 or another suitable element from which electromagnetic waves may be generated to feed one or more waveguide structures and/or received from such waveguide structure(s). In the depicted embodiment, PCB 170 is provided in a separate layer but in other embodiments may be provided in the same layer and be otherwise coupled to antenna block 110. In addition, PCB 170 may be integrally formed with block 110 or coupled thereto, whether layered or side-by-side with the antenna elements of assembly 100.

In some embodiments, one or more of PCBs, PCB layers, or the like may be functionally coupled to block 110 by providing a microstrip and/or patch antenna element 171, as shown in FIG. 2.

Additional transitional elements may be provided to transition between various waveguide grooves of the assembly 100. For example, a terminal ridge 175 may be positioned within opposing rows of posts 172 on another portion of side 112. Ridge 175 may comprise a ledge 176 at which point the height of ridge 175 may be sharply reduced, as best seen in FIG. 1. In alternative embodiments, however, ledge 176 may be replaced with a gradual taper or multiple steps that more gradually reduce the height of ridge 175. As best seen in FIG. 4, the width of ridge 175 is greater than the width of ridge 115 and, as best seen in FIG. 1, the height of the portion of ridge 175 that couples to the adjacent waveguide of block 110 (after the reduction in height resulting from ridge 175) is also less than the height of ridge 115. Thus, to provide a preferably smooth transition between one or both of these dimensions, antenna assembly 100 may further comprise an adapter portion 130.

Adapter portion 130 is configured to facilitate a transition from one waveguide cross-section to another, such as a ridge having a first cross-sectional dimension/area to another having another cross-sectional dimension/area, which may be used in a variety of contexts. In the depicted embodiment, adapter portion 130 may be configured to couple the transition from the waveguide associated with terminal ridge 175 to the waveguide associated with elongated ridge 115. In other embodiments, a similar adapter may be used, for example, to couple a transition between a PCB or other EM-launching element and a first waveguide structure to a gap waveguide structure, which may be used to transition electromagnetic radiation between opposite sides of an antenna block. As discussed in greater detail below, in preferred embodiments, adapter portion 130 may provide a gradual transition between adjacent waveguides or other antennae structures so as to keep reflections low. In addition, in preferred embodiments, adapter portion 130 may act as an impedance transformer within antenna assembly 100.

As shown in FIGS. 1 and 2, adapter portion 130 comprises a ridge 135 that transitions in height and width from one end to the opposite end. Thus, ridge 135 comprises a first end having a first height and a first width and a second end opposite the first end having a second height and a second width. The first height differs from the second height and the first width differs from the second width. More particularly, ridge 135 has a second height at the second end that is greater than the first height at the first end, and has a second width at the second end that is less than the first width at the first end such that ridge 135 of adapter portion 130 transitions from a short, wide base adjacent to the microstrip 171 or other feed element of PCB 170, which may couple with ridge 175, preferably smoothly, to a taller, narrower ridge portion at the opposite end that may, preferably smoothly, couple with ridge 135. Ridge 135 then transitions along a curved portion 136 to direct electromagnetic radiation into the waveguide structures associated with ridge 115. As those of ordinary skill in the art will appreciate, similar to many of the elements shown in the drawings and/or otherwise disclosed herein, curved portion 136 is optional and may form part of ridge 115 in alternative embodiments. In other words, the taper provided by adapter portion 130 may taper to the beginning of a curved section which may be considered part of the adjacent ridge (ridge 115) or the tapering may continue along curved portion 136.

In the depicted embodiment, ridge 135 of adapter portion 130 smoothly transitions between the first width and the second width and smoothly transitions between the first height and the second height. In other words, rather than transitioning in a stepwise manner, ridge 135 tapers in both height and width, which may be preferred for certain applications. However, it is contemplated that one or both of these transitions may be non-smooth in alternative embodiments. For example, in some embodiments, the adapter portion may comprise a ridge that is stepped in height and/or width rather than smoothly tapering. In some embodiments, the adapter portion may comprise a plurality of distinct sections, in which one or more (in some such embodiments, each) of the sections comprises a ridge transitioning between a respective first height and second height differing from the respective first height, and between a respective first width and second width differing from the respective first width, either in a step-wise or smoothly transitioning manner. Each section may then be stepped with respect to the adjacent section if desired. In addition, although in preferred embodiments both the height and the width may taper or otherwise vary in the adapter section, in alternative embodiments, only the height or only the width may so taper/vary. It is also contemplated that in still other embodiments, one or both of the dimensional transitions may be in the opposite direction if desired and/or dictated by design considerations.

It can also be seen in several of the figures that posts 122 may vary in height, width, or other dimensions as needed along various portions of the depicted waveguides. Similarly, the location of the posts 122, including but not limited to their spacing from an adjacent ridge, if present, may vary as needed.

Figure 5:
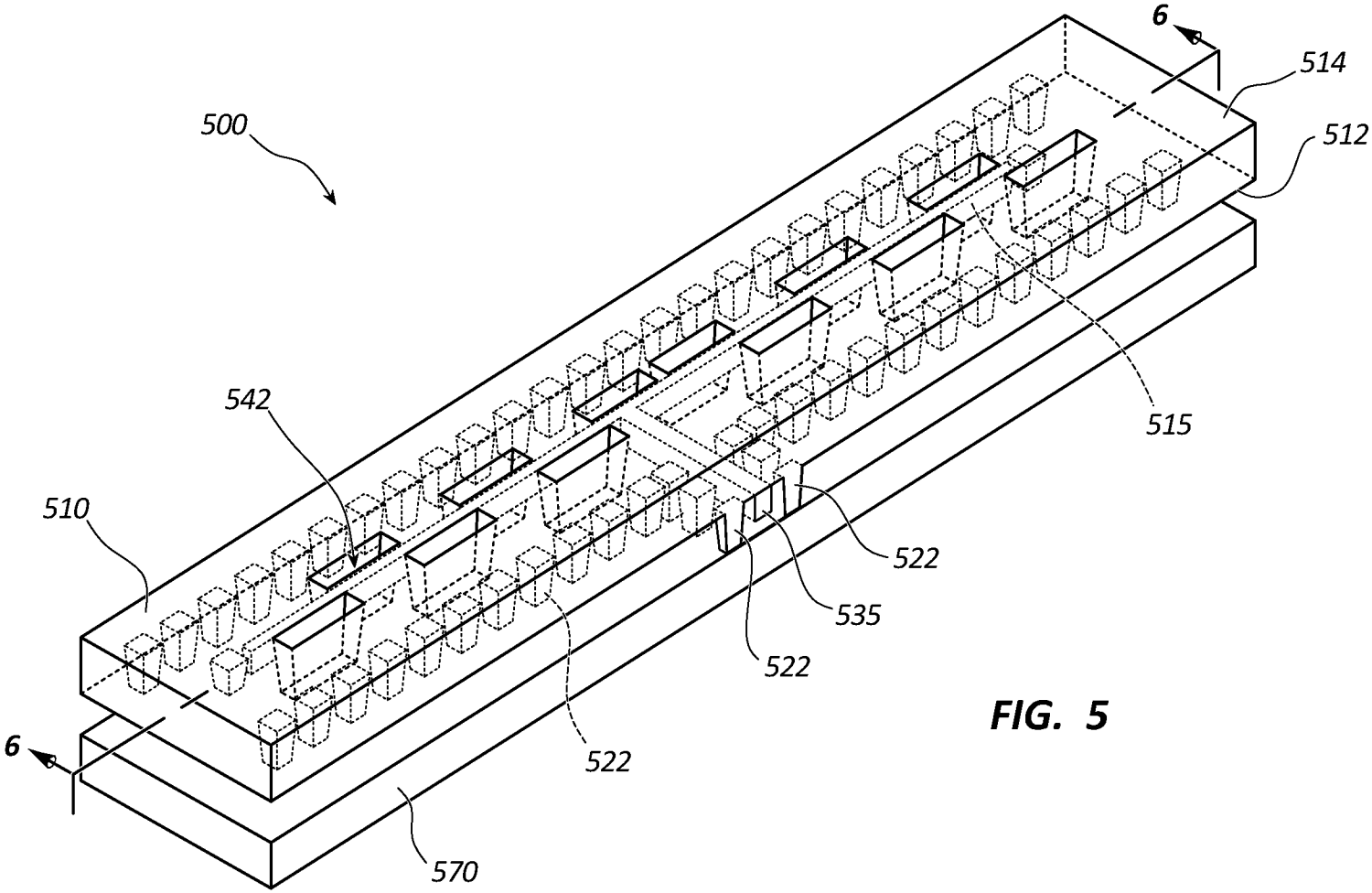
FIG. 5 is a perspective view of an antenna assembly according to another embodiment with the waveguide structures of the antenna block of the assembly shown in phantom.

FIG. 5 depicts another example of an antenna assembly 500 that may be incorporated into or otherwise used with a vehicle sensor, such as a RADAR sensor assembly, according to some embodiments. Antenna assembly 500 again comprises an antenna block 510 that defines, either in whole or in part, one or more waveguides as part of an antenna array comprising one or more antennae, on one or both sides of antenna block 510. Thus, as depicted in FIG. 5, antenna block 510 comprises a plurality of posts 522 arranged in opposing rows on a first side 512 of antenna block 510 opposite a second side 514 of antenna block 510. The opposing rows of posts 522 on side 512 define a waveguide groove therebetween. Again, in preferred embodiments, antenna block 510 may comprise a die cast part that defines all of the posts 522, ridges (such as ridge 515), and slots 542, as discussed below.

Figure 6:
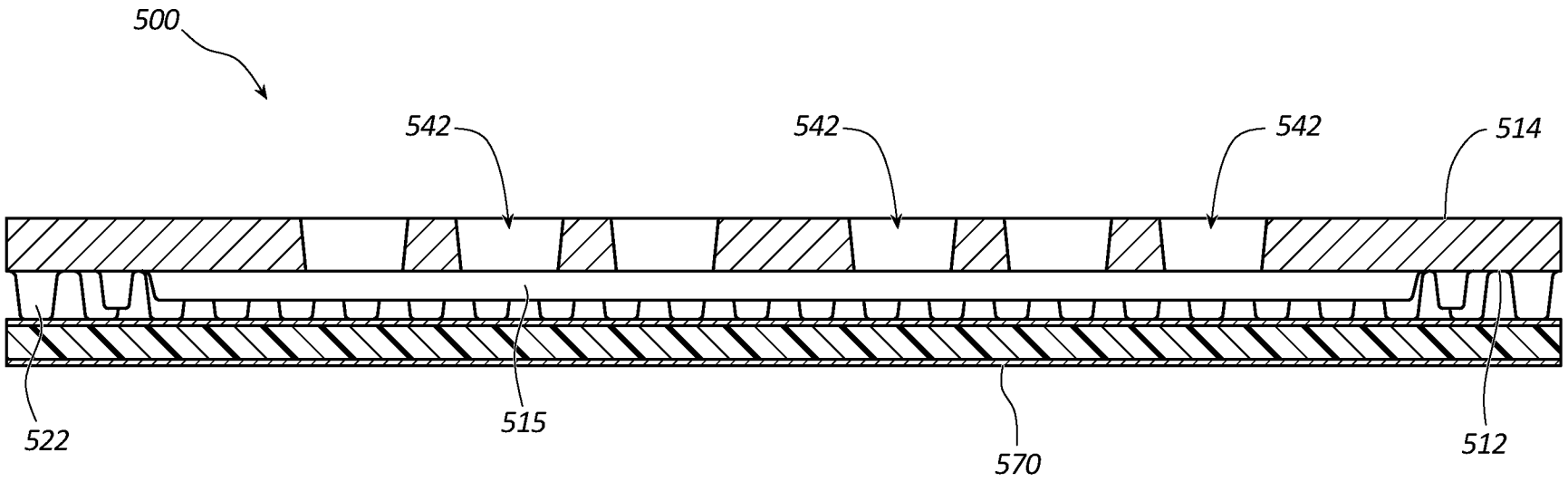
FIG. 6 is a cross-sectional view taken along line 6-6 in FIG. 5.

Block/casting 510 may again comprise a plurality of integrated slots 542 formed therein, which slots 542 preferably taper or otherwise have exterior portions having cross-sectional areas that are larger than the interior portions thereof that are adjacent to ridge 515. Thus, as shown in the cross-sectional view of FIG. 6, slots 542 extend from side 512 to side 514 of block/casting 510, and taper the entire distance between side 512 and side 514 such that a first cross-sectional area is defined at side 512 and a second cross-sectional area is defined at side 514, the second cross-sectional area at side 514 being larger than the first cross-sectional area at side 512 to define a "horn-like" structure, which may be useful for improving the bandwidth-gain product of an associated sensor module or other electronics device. Although not shown in this figure, one or both opposing sides in along a direction normal to the cross-sectional dimension depicted in FIG. 6 may, in some embodiments, also taper or otherwise change between sides 512 and 514. Alternatively, the taper may only take place in one dimension or along one side if desired. Similarly, in other embodiments, the taper may be replaced with one or more steeper transitions to provide slots having opposing ends having cross-sectional areas that differ in other ways.

Ridge 515 extends along preferably a center or at least substantially centrally positioned path along the axis of the waveguide groove formed by opposing rows of posts 522. Slots 542 are again staggered back and forth on opposite sides of ridge 515.

Unlike block/casting 110, block/casting 510 comprises a waveguide groove defined by a single row of posts 522 and comprises a center feed waveguide structure, again defined by opposing posts 522 and comprising a centrally positioned waveguide ridge 535 lacking adjacent slots. Waveguide ridge 535 is coupled to waveguide ridge 515 at a T-junction to allow for coupling of electromagnetic energy to and/or from the waveguide groove associated with waveguide ridge 535 and the waveguide groove associated with waveguide ridge 515. As those of ordinary skill in the art will appreciate, only a portion of the feed waveguide groove structures that would typically be used are shown in the figure. This feed waveguide structure may be coupled to a PCB or other electromagnetic wave-generating element, such as a feed element of PCB 570. In alternative embodiments, however, electromagnetic waves may be delivered from a suitable element positioned at the same level as block/casting 510.

Figure 7:
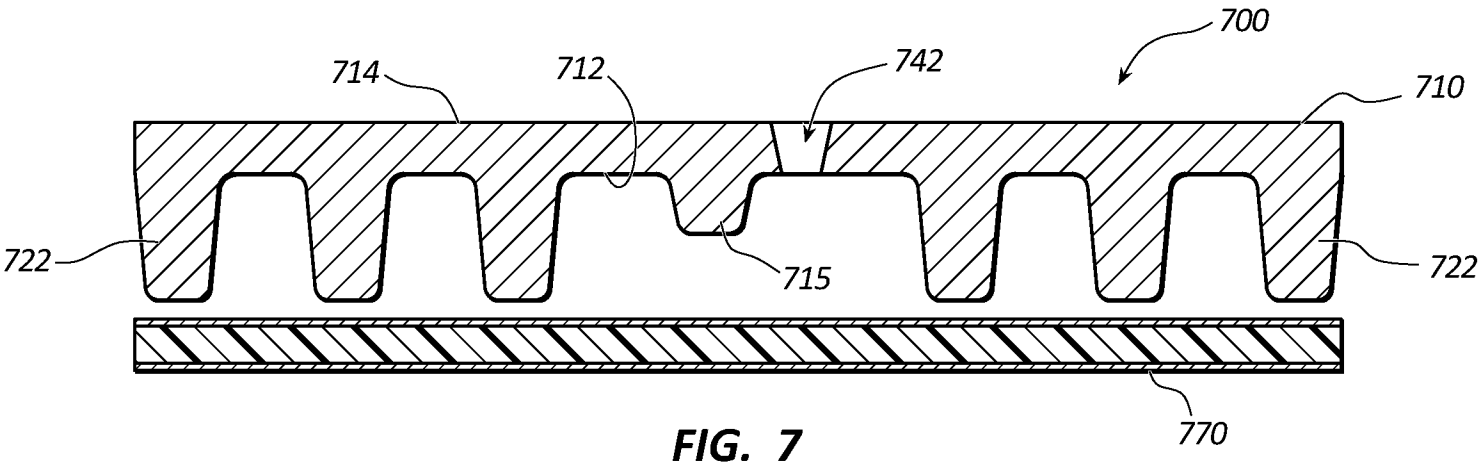
FIG. 7 is a cross-sectional view of another antenna assembly according to still other embodiments.
Figure 8:
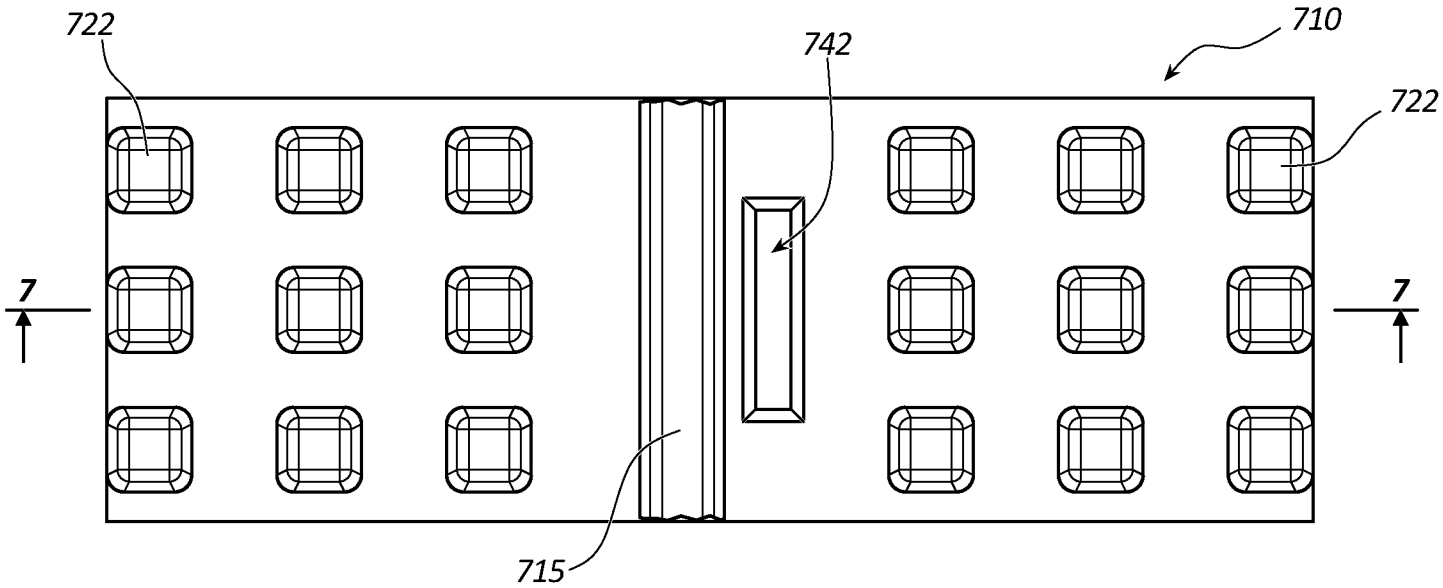
FIG. 8 is a plan view of the antenna assembly of FIG. 7.

FIGS. 7 and 8 are cross-sectional views of an exemplary portion of yet another example of an antenna assembly 700 that may be incorporated into or otherwise used with a vehicle sensor, such as a RADAR sensor assembly, according to some embodiments. Antenna assembly 700 again comprises an antenna block 710 that defines, either in whole or in part, one or more waveguides as part of an antenna array comprising one or more antennae, on one or both sides of antenna block 710. Thus, as depicted in FIG. 7, antenna block 710 comprises a plurality of posts 722 arranged in three sets of opposing rows on each side of a waveguide groove defined therebetween along a first side 712 of antenna block 710. As previously mentioned, block/casting 710 may also be coupled with a means for generating electromagnetic energy, such as a PCB 770, as shown in FIG. 7.

As previously discussed, block/casting 710 may comprise a plurality of integrated slots 742 formed therein, which slots 742 preferably taper or otherwise have exterior portions at side 714 having cross-sectional areas that are larger than the interior portions thereof at side 712, as shown in FIG. 7 and as previously described in connection with other embodiments.

Again, in preferred embodiments, one or more waveguide ridges, such as ridge 715, may be positioned within the waveguide groove formed by opposing rows of posts 722. However, in the depicted embodiment, ridge 715 is not centered within this waveguide groove. Thus, slots 742 may extend adjacent to ridge 715 along the side of ridge 715 having more space within the waveguide groove. Again, however, slots 742 (only one of which is shown in FIGS. 7 and 8) are preferably positioned in a staggered manner so as to extend along one side of the waveguide groove and then the opposite side along the length of the waveguide groove.

Due to this staggered configuration, it may be desirable in some embodiments to stagger ridge 715 in a similar manner. For example, ridge 715 may define separate ridge portions that extend along one side of the waveguide groove, parallel or at least substantially parallel to the axis of the waveguide groove in some embodiments and then the other similar to the slots 742. Alternatively, ridge 715 may comprise a continuous ridge that extends back and forth across the waveguide groove. For example, ridge 715 may comprise portions that extend along one side of the waveguide groove, parallel or at least substantially parallel to the axis of the waveguide groove, then extend across the waveguide groove along an angled portion, and then extend along the opposite side of the waveguide groove, again parallel or at least substantially parallel to the axis of the waveguide groove.

Thus, although the portion of ridge 715 depicted in FIGS. 7 and 8 is straight, it is contemplated that adjacent portions not shown in these figures (again, either continuous or discontinuous portions) may "meander" back and forth from one side of the waveguide groove defined by posts 722 and the other. Without being limited by theory, the present inventors believe that providing this feature, or any of the variations of this feature disclosed herein, may facilitate better travel/coupling of electromagnetic radiation and/or fields along ridge 715 and/or couple the energy more efficiently to the adjacent slots 742.

The contribution of this technique may be twofold. First, proper design of the ridge 715 may allow electric field distribution along the ridge 715 to couple more effectively and/or efficiently with the source of electromagnetic waves and therefore overcome limits to the gain (with low side lobe level) and/or matching bandwidth product that may otherwise be imposed by the use of gap waveguide structures such as the posts 722 shown in the depicted embodiment. This may be interpreted as either providing more bandwidth for fixed gain, more gain for a fixed bandwidth, or both, thereby offering an advantageous design flexibility.

As another potential benefit, providing a meandering ridge may introduce a phase delay in the transmission line without increasing the total effective length of the ridge and thereby reduce the overall required antenna length. Although some of these benefits are thought to be most applicable to gap waveguide structures, it is also contemplated that, as discussed below, use of meandering ridge waveguide antenna structures may also be applicable for use in more conventional parallel-plate or rectangular type waveguide structures and/or other gapless (such as incorporating posts without intervening gaps) waveguide configurations.

One or more of these benefits may be achieved and/or enhanced by staggering the slots 742 to maximize or at least increase their respective distances in a direction perpendicular to the axis of the waveguide groove and/or between opposing sides of the waveguide groove from an adjacent portion of the meandering ridge 715. In other words, the waveguide groove comprises an elongated axis and waveguide ridge 715 intermittently extends on opposite sides of the elongated axis in a periodic or quasi-periodic manner. Moreover, antenna slots 742 may also intermittently extend on opposite sides of the waveguide groove in a periodic or quasi-periodic manner. More particularly, as ridge 715 extends along one side of the waveguide groove, the adjacent slot 742 may extend along the opposite side of the groove so that the space in between each slot 742 and its adjacent waveguide ridge portion (in a direction normal to the axis of the waveguide groove) is maximized, or at least substantially maximized.

In other words, in a waveguide structure adjacent to that shown in FIG. 8 (adjacent either above or below the structure depicted in FIG. 8), in some embodiments, the ridge 715 may be positioned closer to the right side of the groove rather than the left as shown in the figure and the corresponding adjacent slots 742 may be positioned on the left side of the groove (and left of the ridge 715 rather than to the right of the ridge 715 as shown in FIG. 8). Again, the adjacent ridge portions may be continuous with an angled portion connecting them or discontinuous similar to the slots depicted in previous embodiments.

Although the antenna slots 742 are formed in the same structure layer (block 710) in the embodiment of FIGS. 7 and 8, again, in alternative embodiments these slots may be formed in a separate layer or otherwise in a separate structure—in which case the ridge and slots may still meander in a periodic or quasi-periodic manner as previously discussed.

It can also be seen in FIG. 8 that posts 722 may be arranged in parallel rows having equal spacing in some embodiments. Thus, posts 722 are arranged in a manner similar to that of a waffle iron in the depicted embodiment. However, in alternative embodiments, posts 722 may be spaced in a staggered manner relative to the posts 722 in one or more adjacent rows of posts 722. It should also be understood that, although three rows of posts 722 are shown on either side of ridge 715 and its associated waveguide groove, any number of such rows of posts 722 may be provided as desired, although a minimum of two rows of posts on either side of ridge 715 may be preferred for certain applications, particularly in connection with RADAR sensors.

The foregoing specification has been described with reference to various embodiments and implementations. However, one of ordinary skill in the art will appreciate that various modifications and changes can be made without departing from the scope of the present disclosure. For example, various operational steps, as well as components for carrying out operational steps, may be implemented in various ways depending upon the particular application or in consideration of any number of cost functions associated with the operation of the system. Accordingly, any one or more of the steps may be deleted, modified, or combined with other steps. Further, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced, are not to be construed as a critical, a required, or an essential feature or element.

Those having skill in the art will appreciate that many changes may be made to the details of the above-described embodiments without departing from the underlying principles of the invention. The scope of the present inventions should, therefore, be determined only by the following claims.

The invention claimed is:

1. An antenna module, comprising:

an antenna block defining a waveguide groove on a first side of the antenna block, the waveguide groove being defined at least in part by a plurality of posts positioned opposite from one another; and a plurality of antenna slots formed in the antenna block, the plurality of antenna slots extending from the first side of the antenna block to a second side of the antenna block opposite the first side and positioned at least partially within the waveguide groove, wherein each of the plurality of antenna slots comprises a cross-sectional area that is non-constant from the first side of the antenna block to the second side.

2. The antenna module of claim 1, further comprising a printed circuit board coupled with the antenna block and configured to generate electromagnetic waves to feed the waveguide groove, wherein the plurality of antenna slots formed in the antenna block is configured to transmit electromagnetic waves therethrough from the antenna block.

3. The antenna module of claim 1, further comprising a waveguide ridge positioned within the waveguide groove, and wherein each of the plurality of antenna slots is formed within the waveguide groove adjacent to the waveguide ridge.

4. The antenna module of claim 3, wherein each of the plurality of antenna slots is formed within the waveguide groove in a staggered manner such that each antenna slot of the plurality of antenna slots is positioned on an opposite side of the waveguide ridge relative to an adjacent antenna slot of the plurality of antenna slots.

5. The antenna module of claim 1, wherein the plurality of posts comprises a first set of posts comprising at least two rows of posts positioned on a first side of the waveguide groove and a second set of posts comprising at least two rows of posts positioned on a second side of the waveguide groove opposite the first side.

6. The antenna module of claim 1, wherein each of the plurality of antenna slots tapers from a narrow cross-sectional area at the first side to a wider cross-sectional area at the second side.

7. The antenna module of claim 6, wherein each of the plurality of antenna slots tapers from a first rectangular cross-sectional area at the first side to a second rectangular cross-sectional area at the second side, wherein the first rectangular cross-sectional area is smaller than the second rectangular cross-sectional area.

8. An antenna module, comprising:

an antenna block defining a plurality of waveguide grooves on a first side of the antenna block, wherein the plurality of waveguide grooves comprises a feed waveguide groove and an antenna waveguide groove coupled with the feed waveguide groove, and wherein the antenna waveguide groove is offset from the feed waveguide groove;

a plurality of antenna slots formed in the antenna block, the plurality of antenna slots extending from the first side of the antenna block to a second side of the antenna block opposite the first side and positioned at least partially within the antenna waveguide groove; and a printed circuit board coupled with the antenna block and configured to generate electromagnetic waves to be sent into the feed waveguide groove, wherein the plurality of antenna slots formed in the antenna block is configured to transmit electromagnetic waves therethrough from the antenna waveguide groove.

9. The antenna module of claim 8, wherein the antenna waveguide groove is defined at least in part by a plurality of posts positioned opposite from one another.

10. The antenna module of claim 9, wherein the feed waveguide groove is defined at least in part by a plurality of posts positioned opposite from one another.

11. The antenna module of claim 8, further comprising an antenna waveguide ridge positioned within the antenna waveguide groove.

12. The antenna module of claim 11, further comprising a feed waveguide ridge positioned within the feed waveguide groove.

13. The antenna module of claim 12, wherein the feed waveguide ridge is coupled to the antenna waveguide ridge at a T-junction.

14. The antenna module of claim 12, wherein the feed waveguide ridge narrows in width in a direction towards the antenna waveguide ridge.

15. The antenna module of claim 8, wherein each of the plurality of slots comprises a cross-sectional area that narrows from the first side to the second side.

16. An antenna module, comprising:

an antenna block comprising:

a first plurality of posts positioned opposite from one another to define a feed waveguide groove on a first side of the antenna block;

a feed waveguide ridge extending within the feed waveguide groove;

a second plurality of posts positioned opposite from one another to define an antenna waveguide groove on the first side of the antenna block, wherein the antenna waveguide groove is offset from the feed waveguide groove;

an antenna waveguide ridge extending within the antenna waveguide groove, wherein the feed waveguide ridge extends into the antenna waveguide ridge at a junction region; and a plurality of antenna slots formed in the antenna block, the plurality of antenna slots extending from the first side of the antenna block to a second side of the antenna block opposite the first side, wherein each of the plurality of antenna slots is positioned at least partially within the antenna waveguide groove, and wherein each of the plurality of antenna slots is offset from the antenna waveguide ridge; and a printed circuit board coupled with the antenna block and configured to generate electromagnetic waves to be sent into the feed waveguide groove.

17. The antenna module of claim 16, wherein the feed waveguide ridge extends into the antenna waveguide ridge at an at least substantially perpendicular angle at the junction region.

18. The antenna module of claim 16, wherein each of the plurality of slots comprises a cross-sectional area that narrows from the first side to the second side.

19. The antenna module of claim 16, wherein the feed waveguide ridge narrows in width in a direction towards the antenna waveguide ridge.

* * * * *